US010113390B2

(12) United States Patent
Langlais et al.

(10) Patent No.: US 10,113,390 B2
(45) Date of Patent: Oct. 30, 2018

(54) VALVE FOR GRAVEL PACKING A WELLBORE

(71) Applicant: Schlumberger Technology Corporation, Sugar Land, TX (US)

(72) Inventors: Michael Langlais, Houston, TX (US); Bryan Stamm, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 480 days.

(21) Appl. No.: 14/698,597

(22) Filed: Apr. 28, 2015

(65) Prior Publication Data

US 2015/0308239 A1 Oct. 29, 2015

Related U.S. Application Data

(60) Provisional application No. 61/991,160, filed on May 9, 2014, provisional application No. 61/985,289, filed on Apr. 28, 2014.

(51) Int. Cl.

| | |
|---|---|
| ***E21B 34/06*** | (2006.01) |
| ***E21B 43/08*** | (2006.01) |
| ***E21B 43/12*** | (2006.01) |

(52) U.S. Cl.

CPC ..... *E21B 34/06* (2013.01); *E21B 43/08* (2013.01); *E21B 43/12* (2013.01)

(58) Field of Classification Search

CPC ..... E21B 34/063; E21B 43/04; E21B 43/045

See application file for complete search history.

(56) References Cited

U.S. PATENT DOCUMENTS

| | | | | |
|---|---|---|---|---|
| 4,428,428 | A * | 1/1984 | Smyrl | E21B 34/063 166/278 |
| 6,176,307 | B1 * | 1/2001 | Danos | E21B 43/04 166/276 |
| 6,371,210 | B1 | 4/2002 | Bode et al. | |
| 6,505,682 | B2 | 1/2003 | Brockman | |
| 6,622,794 | B2 | 9/2003 | Zisk, Jr. | |
| 7,100,686 | B2 | 9/2006 | Wittrisch | |
| 7,185,706 | B2 | 3/2007 | Freyer | |
| 7,290,606 | B2 | 11/2007 | Coronado et al. | |
| 7,409,999 | B2 | 8/2008 | Henriksen et al. | |
| 7,523,787 | B2 | 4/2009 | Richards et al. | |
| 7,708,068 | B2 | 5/2010 | Hailey, Jr. | |
| 7,789,145 | B2 | 9/2010 | Patel | |

(Continued)

FOREIGN PATENT DOCUMENTS

WO 2013187878 A1 12/2013

OTHER PUBLICATIONS

PCT/US2015/028010, International Search Report and Written Opinion, dated Aug. 6, 2015, 13 pgs.

(Continued)

*Primary Examiner* — Shane Bomar

(57) ABSTRACT

A downhole tool includes a housing. The housing includes a screen. A valve system is positioned within the housing. The valve system includes a valve and a flow control device. The valve system has a first position where the valve allows a flow within the housing, a second position where the valve directs at least a portion of the flow through the flow control device, and a third position stopping flow through the flow control device.

25 Claims, 11 Drawing Sheets

(56) References Cited

U.S. PATENT DOCUMENTS

| | | | | |
|---|---|---|---|---|
| 7,828,067 | B2 | 11/2010 | Scott et al. | |
| 7,971,642 | B2 | 7/2011 | Yeh et al. | |
| 7,984,760 | B2 | 7/2011 | Haeberle et al. | |
| 7,987,909 | B2 | 8/2011 | Pineda et al. | |
| 8,127,831 | B2 | 3/2012 | Haeberle et al. | |
| 8,453,746 | B2 | 6/2013 | Hailey, Jr. et al. | |
| 8,485,265 | B2 | 7/2013 | Marya et al. | |
| 8,622,125 | B2 | 1/2014 | Weirich et al. | |
| 2002/0079099 | A1 | 6/2002 | Hurst et al. | |
| 2003/0111224 | A1 | 6/2003 | Hailey, Jr. et al. | |
| 2004/0020832 | A1* | 2/2004 | Richards | E21B 34/06 210/106 |
| 2004/0140089 | A1 | 7/2004 | Gunneroed | |
| 2005/0072576 | A1 | 4/2005 | Henriksen et al. | |
| 2005/0082060 | A1 | 4/2005 | Ward et al. | |
| 2006/0042798 | A1 | 3/2006 | Badalamenti et al. | |
| 2006/0073986 | A1* | 4/2006 | Jones | C09K 8/36 507/129 |
| 2007/0044962 | A1 | 3/2007 | Tibbles | |
| 2007/0246213 | A1 | 10/2007 | Hailey | |
| 2008/0283238 | A1 | 11/2008 | Richards et al. | |
| 2008/0314589 | A1 | 12/2008 | Guignard et al. | |
| 2009/0008078 | A1 | 1/2009 | Patel | |
| 2009/0101354 | A1 | 4/2009 | Holmes et al. | |
| 2009/0151925 | A1* | 6/2009 | Richards | E21B 34/06 166/53 |
| 2010/0032158 | A1 | 2/2010 | Dale et al. | |
| 2010/0059232 | A1 | 3/2010 | Langlais et al. | |
| 2011/0011586 | A1* | 1/2011 | Dusterhoft | E21B 43/08 166/278 |
| 2011/0073308 | A1 | 3/2011 | Assal et al. | |
| 2011/0094742 | A1 | 4/2011 | Badalamenti et al. | |
| 2011/0139465 | A1* | 6/2011 | Tibbles | E21B 33/124 166/387 |
| 2011/0198097 | A1* | 8/2011 | Moen | E21B 34/08 166/373 |
| 2011/0203793 | A1 | 8/2011 | Tibbles | |
| 2011/0239754 | A1 | 10/2011 | Dyer et al. | |
| 2011/0303420 | A1 | 12/2011 | Thorkildsen et al. | |
| 2012/0067588 | A1 | 3/2012 | Awid et al. | |
| 2012/0305243 | A1 | 12/2012 | Hallundb.ae butted.k et al. | |
| 2013/0014953 | A1 | 1/2013 | van Petegem | |
| 2013/0081800 | A1 | 4/2013 | Riisem et al. | |
| 2013/0092394 | A1* | 4/2013 | Holderman | E21B 43/08 166/373 |
| 2013/0139465 | A1 | 6/2013 | Kuryk et al. | |
| 2013/0228341 | A1* | 9/2013 | Fripp | E21B 43/12 166/373 |
| 2013/0319664 | A1* | 12/2013 | McNamee | E21B 34/08 166/276 |
| 2014/0014357 | A1 | 1/2014 | Riisem | |
| 2015/0027700 | A1* | 1/2015 | Riisem | E21B 43/04 166/278 |
| 2015/0198016 | A1 | 7/2015 | Langlais | |
| 2015/0308239 | A1 | 10/2015 | Langlais et al. | |

OTHER PUBLICATIONS

PCT/US2015/027997, International Search Report and Written Opinion, dated Aug. 7, 2015, 13 pgs.

PCT/US2014/066028, International Search Report and Written Opinion, dated Feb. 24, 2015, 10 pgs.

PCT/US2014/048139, International Search Report and Written Opinion, dated Nov. 13, 2014, 15 pgs.

European Search Report for related EP Application Serial No. 15785240.1, dated Nov. 22, 2017, 9 pages.

Office Action for related Russian Application Serial No. 2016146216/03, dated Jul. 24, 2017, 9 pages.

Office Action for corresponding Russian Application Serial No. 2016146220/03, dated Aug. 14, 2017, 8 pages.

Aviles, et al., "Degradable Frac Ball Holds Solution to Persistent Problem in Fracturing", Journal of Petroleum Technology; Society of Petroleum Engineers, Nov. 2013, pp. 32-33.

Schlumberger, "Elemental Degradable Technology", http://www.slb.com/services/completions/completion_products/multistage_stimulation_systems/elementals.aspx, 2013, 3 pages.

Schlumberger, "Elemental Degradable Technology Frac Balls", slb.com/elemental, 2013, 2 pages.

European Extended Search Report for corresponding European Application Serial No. 15785259.1, 6 pages.

* cited by examiner

VALVE FOR GRAVEL PACKING A WELLBORE

CROSS-REFERENCE TO RELATED APPLICATIONS

This application claims priority to U.S. Provisional Patent Application having Ser. No. 61/991,160 filed on May 9, 2014, entitled "Three Stage Valve for Gravel Packing a Wellbore," to Michael Langlais. This application also claims priority to U.S. Provisional Patent Application having Ser. No. 61/985,289, filed on Apr. 28, 2014, entitled "System and Method for Obstructing a Flowpath in a Wellbore," to Michael Langlais. The disclosures of both applications are incorporated by reference herein in their entirety.

FIELD

Embodiments described herein generally relate to downhole tools. More particularly, such embodiments relate systems and methods for obstructing a flowpath in a wellbore.

BACKGROUND INFORMATION

A completion assembly is oftentimes run into a wellbore before the wellbore begins producing hydrocarbon fluids from the surrounding formation. The completion assembly may include a base pipe and a screen disposed thereabout. The base pipe may have one or more openings formed radially therethrough. The openings may have nozzles disposed therein, each having an inner diameter from about 1.5 mm to about 4 mm. These openings with the nozzles disposed therein are referred to as inflow control devices ("ICDs") and are designed to control the rate of the hydrocarbon fluids flowing into the base pipe and up to the surface.

Once the completion assembly is in place in the wellbore, an annulus between the completion assembly and the wellbore wall may be packed with gravel prior to producing the hydrocarbon fluids from the surrounding formation. To gravel pack the annulus, a gravel slurry is pumped from the surface down through the annulus. The gravel slurry includes a plurality of gravel particles dispersed in a carrier fluid. When the gravel slurry reaches the screen in the completion assembly, the carrier fluid flows radially-inward through the screen, leaving the gravel particles in the annulus to form a "gravel pack" around the screen. The carrier fluid then flows into the base pipe and up to the surface. As the gravel slurry may be pumped into the annulus at about 5-10 barrels per minute, the inflow control devices may not provide a large enough cross-sectional area for the carrier fluid to flow through to the base pipe.

To increase the cross-sectional area through which the carrier fluid may flow, one or more additional openings may be formed in the base pipe. The additional openings may be axially-offset from the screen and/or the ICDs. Once the gravel packing process is complete, the flowpath through the annulus to the additional openings is obstructed, causing fluid (e.g., hydrocarbon fluid) to flow through the ICDs into the base pipe. The flow path may be obstructed by expanding a swellable elastomeric device disposed between the base pipe and a non-permeable housing positioned radially-outward therefrom.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

A downhole tool is disclosed. The downhole tool includes a housing. The housing includes a screen. A valve system is positioned within the housing. The valve system includes a valve and a flow control device. The valve system has a first position where the valve allows a flow within the housing, a second position where the valve directs at least a portion of the flow through the flow control device, and a third position stopping flow through the flow control device.

In another embodiment, the downhole tool includes a housing. The housing includes a screen. An inner tubular member is positioned radially-inward from the housing such that an annulus is formed therebetween, and a first opening is formed radially-through the inner tubular member. A valve system is positioned within the annulus. The valve system includes an intermediate tubular member having a second opening formed radially-therethrough. A first valve is positioned at least partially in the intermediate tubular member. The first valve has an axial bore formed at least partially therethrough, and a third opening is formed radially-through the first valve. A flow control device is positioned within the axial bore. The valve system also includes a first degradable member that is configured to at least partially degrade in response to contact with a first fluid. The valve system has a first position where the first valve allows a flow within the housing, a second position where the first valve directs at least a portion of the flow through the flow control device, and a third position stopping flow through the flow control device.

A method for gravel packing a wellbore is also disclosed. The method includes degrading a degradable member in a downhole tool. The downhole tool includes a screen, a valve system, and a flow control device. The valve system includes a first valve. The first valve moves with respect to the screen in response to the degradable member at least partially degrading. The first valve may direct at least a portion of the fluid that flows through the screen to flow through the flow control device after the first valve moves.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered to limit the scope of the application.

DETAILED DESCRIPTION

Figure 1A:
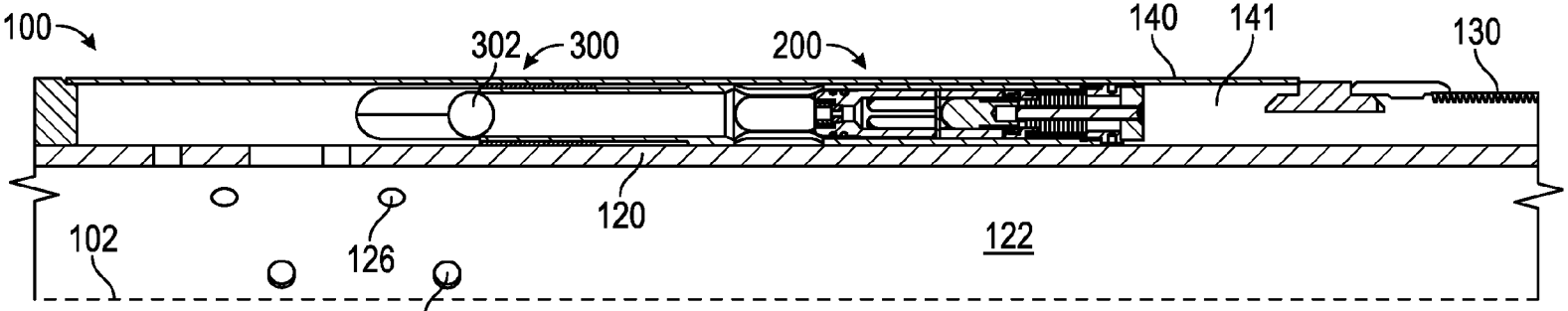
FIG. 1A depicts a partial cross-sectional view of an illustrative downhole tool having a valve system, according to one or more embodiments disclosed.

A downhole tool 100 may include a screen 130 and a housing 140. A valve system 200 may be positioned within the housing 140. The valve system 200 may include a valve 220, 200A and a flow control device 222, 250. The valve system 200 may have a first position where the valve 220 allows a flow within the housing 140, a second position where the valve 220 directs at least a portion of the flow through the flow control device 222, and a third position stopping flow through the flow control device 222. Actuation of the valve 220 may thereby change a proportion of the fluid that flows through the screen 130 that flows through the flow control device 222, 250. Said another way, the proportion of the fluid that flows through the flow control device 222, 250 after entering the screen 130 may change (e.g., increase).

Figure 2:
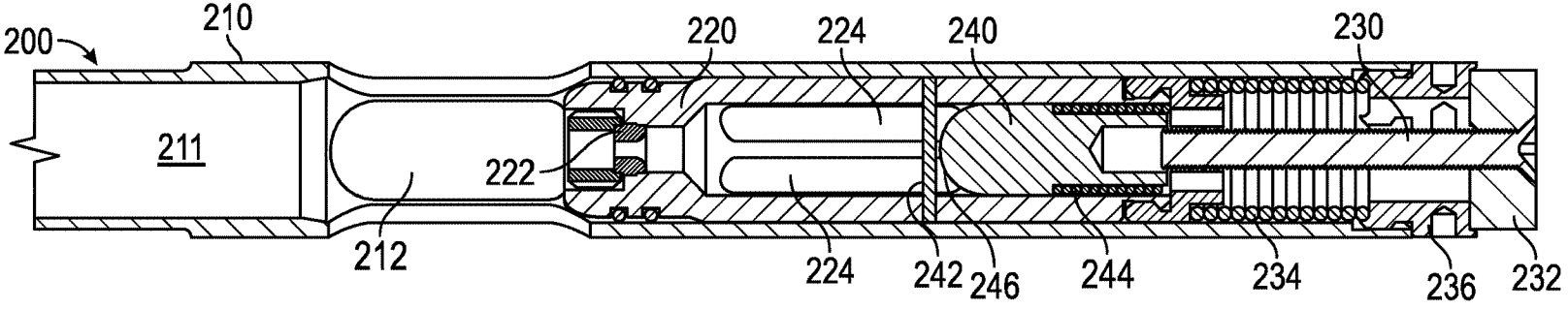
FIG. 2 depicts a cross-sectional view of the valve system in a first position, according to one or more embodiments disclosed.

For example, with reference to FIGS. 1A and 2, when the valve system 200 is in the first position (e.g., during the gravel packing phase), at least a portion of the fluid entering the screen 130 (e.g., 100%) may flow through valve system 200 to the openings 126. This fluid may not flow through the flow control device 222. However, when the valve system 200 is in the second position (e.g., during the production phase), at least a portion of the fluid (e.g., 100%) of the fluid that enters the screen 130 may flow through the flow control device 222 and to the openings 126. When the valve system 200 is in the third position, no fluid may flow from the screen 130 to the openings 126.

FIG. 1A depicts a partial cross-sectional view of an illustrative downhole tool 100 having valve system 200, according to one or more embodiments disclosed. More particularly, a cross-section of the downhole tool 100 above the central longitudinal axis 102 is shown, while the portion of the cross-section of the downhole tool 100 below the longitudinal axis 102 has been omitted. As shown, the downhole tool 100 may be, include, or form a part of a completion assembly. However, in other embodiments, instead of or in addition to the completion assembly, the downhole tool 100 may be or include a packer, such as an open hole swellable packer or a shunted zonal isolation packer.

The downhole tool 100 may include a first or inner tubular member 120 having an axial bore 122 formed therethrough. The inner tubular member 120 may be referred to as a base pipe. An outer tubular member (referred to as a "housing") 140 may be disposed at least partially around the base pipe 120. The housing 140 may be in the form of a single tube or multiple tubes or sections of tube or housing joined together. The housing 140 may also include one or more screens 130 or screened sections coupled thereto or integral therewith. As such, the screen 130 may be disposed at least partially around the base pipe 120 and axially-adjacent to the housing 140. The screen 130 may be or include a wire wrapped helically around the base pipe 120, a mesh, a slotted liner, or the like configured to filter wellbore solids. A housing annulus 141 may be formed between the base pipe 120 (on the inside) and the screen 130 and housing 140 (on the outside).

One or more openings 126 may be formed radially-through the base pipe 120. The openings 126 may be axially-offset from the screen 130 and axially-aligned with the housing 140. The number of openings 126 may be from about 1 to about 10, from about 10 to about 20, from about 20 to about 50, from about 50 to about 200, or more. The openings 126 may be axially and/or circumferentially-offset from one another. Each opening 126 may have a diameter from less than about 5 mm to about 25 mm or more, for example, about 6 mm to about 15 mm or about 8 mm to about 10 mm.

A valve system 200 may be positioned in the housing annulus 141. For example, the valve system 200 may be positioned axially-between the openings 126 in the base pipe 120 and the screen 130. The valve system 200 will be discussed in greater detail below.

In at least one embodiment, a check valve 300 may also be positioned in the housing annulus 141. For example, the check valve 300 may be positioned axially-between the openings 126 in the base pipe 120 and the valve system 200. The check valve 300 may be or include a ball valve, a sliding sleeve, a hinged-flapper, or any other type of valve. In the illustrated embodiment, the check valve 300 includes an impediment (e.g., a ball) 302 that allows fluid flow therethrough in one axial direction but not the opposing axial direction.

As the downhole tool 100 is being run into a wellbore, fluid may be pumped into the base pipe 120 from a surface location. The check valve 300 may prevent the fluid from flowing through the openings 126 in the base pipe 120, through the housing annulus 141, and out the screen 130. In at least one embodiment, the check valve 300 may allow the downhole tool 100 to be run without a wash pipe inside, which is normally required to provide a conduit for wash down fluids to reach the bottom of the completion assembly. The check valve 300 may, however, be configured to allow fluid flow in the opposite direction (i.e., from the screen 130, through the housing annulus 141, and into the base pipe 120 through the openings 126). In at least one embodiment, at least a portion of the check valve 300 (e.g., the ball 302) may be made from a material that is configured to degrade in less than one day, less than 1 week, less than one month, or more than one month in response to contact with a fluid in the wellbore. The portion of the check valve 300 (e.g., the ball 302) may degrade before a fluid is injected that causes the valve system 200 to move to a third position, as discussed in greater detail below with reference to FIGS. 6 and 7.

Figure 1B:
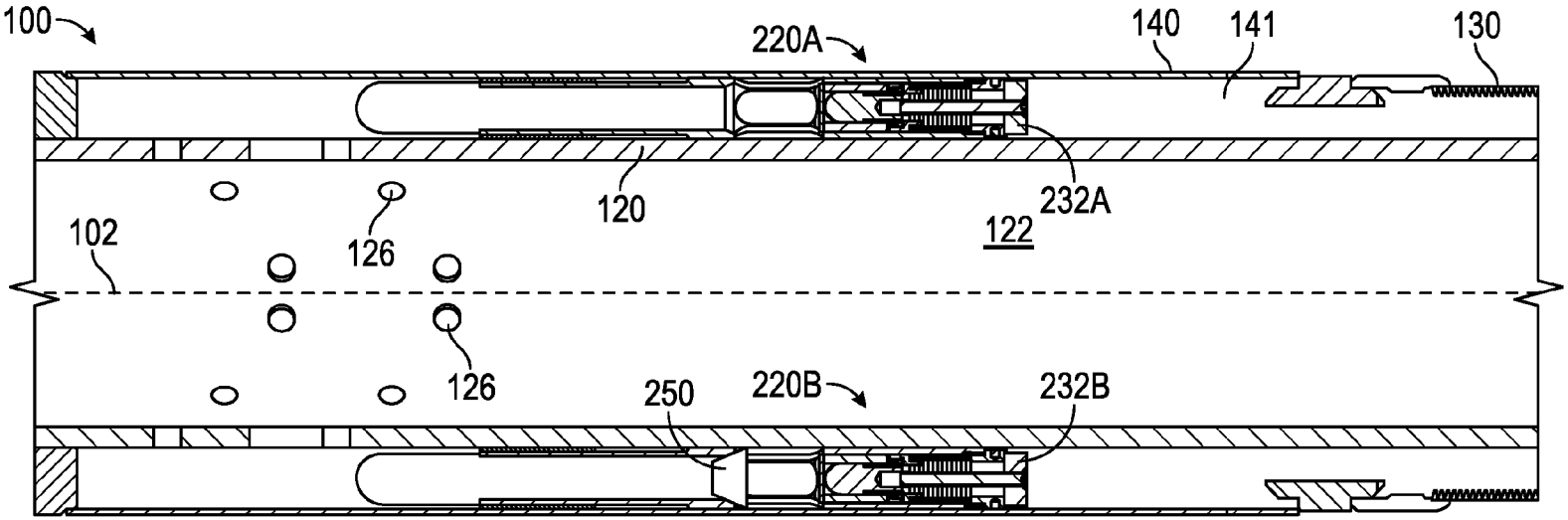
FIG. 1B depicts a cross-sectional view of the downhole tool including first and second valve systems, according to one or more embodiments disclosed.

FIG. 1B depicts a cross-sectional view of the downhole tool 100 including a valve system including two valves: first valve 220A and second valve 220B, according to one or more embodiments disclosed. The first and second valves 220A, 220B may each include a degradable member 232A, 232B, respectively. Although shown in a first position in FIG. 1B, the first valve 220A may be configured to actuate into the valve system's second position in response to the degradable members 232A at least partially degrading. While the valve system is in its second position, the valve system's second valve 220B allows fluid flow through the flow control device 250. The actuation of the second valve 220B moves the valve system to its third position, where the second valve 220B blocks flow through the flow control devices 250. In at least one embodiment, the first and second degradable members 232A, 232B may be made of different materials that are configured to at least partially degrade in response to contact with different fluids. In another embodiment, the first and second degradable members 232A, 232B may be configured to at least partially degrade at different rates in response to contact with the same fluid.

A flow control device 250 may be positioned in the flowpath of the second valve 220B. More particularly, the flow control device 250 may be positioned between the second valve 220B and the openings 126. The flow control device 250 may be an inflow control device ("ICD") or an injection flow control device. An injection flow control device refers to an ICD that is configured to control flow out of the base pipe 120 rather than into the base pipe 120. ICDs may include both passive ICDs and autonomous ICDs ("AICDs"). Passive ICDs refer to ICDs that restrict fluid flow without being selective of fluids with certain composition or physical characteristics. Examples of such passive ICDs include nozzles, tortuous paths, and friction tubes. Autonomous ICDs refer to ICDs that change their flow restriction characteristics based on the fluid's composition or physical characteristics. For example, an AICD may have increased flow restriction when the water or gas content of the production fluid increases. Examples of AICDs include AICDs that use the Bernoulli principle, such as Tendeka's FloSure™ AICD, or other type of AICDs, such as Halliburton's EquiFlow® AICD.

In at least one embodiment, the intermediate tubular member 210 may be coupled (e.g., threadably coupled) to a single opening 126. In another embodiment, the intermediate tubular member 210 may be coupled to a conduit extending to the opening 126. Furthermore, if two valve systems 200 are adjacent, collinear, and/or opposing one another, these two valve systems 200 may be threadably coupled to the single opening 126. The single opening 126 may have a diameter of from about 25 mm to about 75 mm. In these embodiments, the annular barrier may not be present or may not extend completely across the housing annulus 141; rather, the barrier may be accomplished by the threads when the intermediate tubular members 210 are coupled to the opening 126.

FIG. 2 depicts a cross-sectional view of the valve system 200 in a first position, according to one or more embodiments disclosed. The valve system 200 may include an intermediate tubular member 210 having an axial bore 211 formed at least partially therethrough. The tubular member 210 may have one or more openings 212 formed radially-therethrough that provide a path of fluid communication to the bore 211. The openings 212 may be axially and/or circumferentially-offset from one another.

A valve 220 may be positioned in the intermediate tubular member 210. The valve 220 may include a single component or two or more components coupled together. The valve 220 may include a flow control device 222, which may be similar to the flow control device 250 described above. For example, the flow control device 222 may be or include a nozzle configured to restrict or reduce an amount of fluid that is able to flow through a flowpath that extends at least partially through the valve 220. The valve 220 may also include one or more openings 224 formed radially-therethrough. The openings 224 may be axially and/or circumferentially-offset from one another.

A first biasing member (e.g., a spring) 234 may be positioned adjacent to the valve 220 and exert a force on the valve 220 toward the openings 212 in the intermediate tubular member 210 (e.g., to the left, as shown in FIG. 2). However, the valve 220 may be secured in place by a bolt or shaft 230, thereby maintaining the first biasing member 234 in a first, compressed state. A first end of the shaft 230 may be coupled (e.g., threaded) to the valve 220. The shaft 230 may be positioned radially-inward from the first spring 234.

A second end of the shaft 230 may be coupled (e.g., via an upset on the shaft 230) to a first swellable or degradable member 232. Contact between the first swellable or degradable member 232 and an end cap 236 coupled to the intermediate tubular member 210 may prevent the valve 220 and the shaft 230 from moving toward the openings 212 in the intermediate tubular member 210. In at least one embodiment, the end cap 236 may be omitted, and the first swellable or degradable member 232 may contact the intermediate tubular member 210. The downhole tool 100 may be run into the wellbore in a fluid that does not degrade the first swellable or degradable member 232. For example, the fluid may be an oil-based fluid. In some embodiments, the valve system is in a first position allowing a fluid flow through the opening 212 to be relatively unrestricted (e.g. during a gravel packing operation) prior to the valve 220 actuating from the first position to a second position (also the second position of the valve system 200) where an increased portion of fluid flow through the screen 130 is directed through the flow control devices 222 (e.g. during the production of the well).

The valve 220 may include a body 240 at least partially positioned therein. In some embodiments, the body 240 may move within the valve 220, thereby actuating the valve system 200 from a second position allowing flow though the flow control device 222 (e.g. during production) to a third position block flow through the flow control device (e.g., to close the off the screen when water content is too high so that other screens in the completion may still be used for production). The body 240 may include a nose or plug 246 having a reduced cross-sectional area that extends axially therefrom. A second biasing member (e.g., a spring) 244 may be adjacent to and/or at least partially positioned within the body 240. The second biasing member 244 may exert a force on the body 240 toward the flow control device 222 in the valve 220. However, the body 240 may be secured in place by a second swellable or degradable member 242. The second swellable or degradable member 242 may be coupled to and/or positioned between the valve 220 and the body 240.

The valve system 200 is in a first position in FIG. 2. In the first position, the contact between the first swellable or degradable member 232 and the end cap 236 (or the tubular member 210) secures the valve 220 in place so that the valve 220 is misaligned or axially-offset from the opening(s) 212 in the intermediate tubular member 210. In addition, when in the first position, the second swellable or degradable member 242 may secure the body 240 in place so that the body 240 is misaligned or axially-offset from the flow control device 222.

Figure 3:
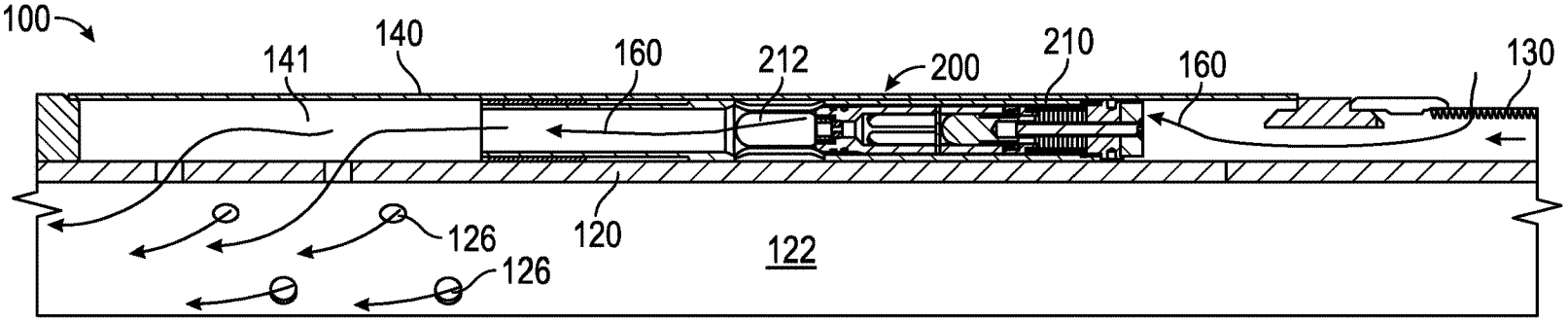
FIG. 3 depicts a partial cross-sectional view of the downhole tool showing the valve system in the first position, according to one or more embodiments disclosed.

FIG. 3 depicts a partial cross-sectional view of the downhole tool 100 having the valve system 200 disposed therein and in the first position, according to one or more embodiments disclosed. Once the downhole tool 100 is in the desired position in the wellbore, an annulus ("wellbore annulus") between the downhole tool 100 and the wellbore wall may be gravel packed prior to actuating the valve system 200. To gravel pack the wellbore annulus, a gravel slurry may be pumped down the wellbore annulus from the surface. When the gravel slurry reaches the screen 130, the carrier fluid in the gravel slurry may flow from the wellbore annulus, through the screen 130, and into the housing annulus 141. The gravel particles may be left in the wellbore annulus proximate to the screen 130.

An annular barrier (not shown) may be present in the housing annulus 141 axially-between the openings 212 in the tubular member 210 and the openings 126 in the base pipe 120. The intermediate tubular member 210 may provide a path of fluid communication 160 through the annular barrier. The flowpath 160 may extend from housing annulus 141, into the intermediate tubular member 210 through the openings 212 in the intermediate tubular member 210, and into the base pipe 120 through the openings 126 in the base pipe 120. The flowpath 160 may be unobstructed by the valve system 200 (e.g., the valve 220 in the valve system 200) when the valve system 200 is in the first position.

In at least one embodiment, the housing 140 may have "filtered" communication with the wellbore annulus. More particularly, the portion of the housing 140 between the annular barrier and the screen 130 may have one or more openings formed radially-therethrough, and a filter (e.g., a mesh wrap or screen) may be positioned over the openings. The filtered openings may be used to install the valve system 200. This may be used during dehydration during gravel packing depending on the length of the "upstream" portion of the housing 140.

Figure 4:
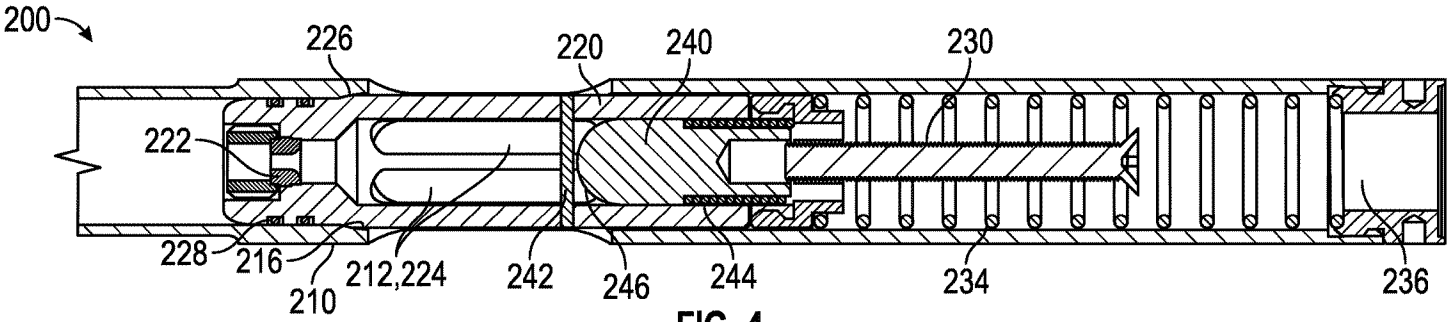
FIG. 4 depicts a cross-sectional view of the valve system in a second position, according to one or more embodiments disclosed.

FIG. 4 depicts a cross-sectional view of the valve system 200 in a second position, according to one or more embodiments disclosed. The first swellable or degradable member 232 (see FIG. 2) may be made of one or more materials that are configured to swell or degrade in response to contact with a first fluid. More particularly, the first swellable or degradable member 232 may swell or degrade sufficiently to release the shaft 230 therefrom in a predetermined amount of time in response to contact with the first fluid, as shown in FIG. 4. The first fluid may be or include a gravel packing fluid, a spacer fluid, or a water-based fluid.

Illustrative swellable materials may include ethylene-propylene-copolymer rubber, ethylene-propylene-diene terpolymer rubber, butyl rubber, halogenated butyl rubber, brominated butyl rubber, chlorinated butyl rubber, chlorinated polyethylene, starch-polyacrylate acid graft copolymer, polyvinyl alcohol cyclic acid anhydride graft copolymer, isobutylene maleic anhydride, acrylic acid type polymers, vinylacetate-acrylate copolymer, polyethylene oxide polymers, carboxymethyl cellulose type polymers, starch-polyacrylonitrile graft copolymers, highly swelling clay minerals (i.e. sodium bentonite), styrene butadiene hydrocarbon, ethylene propylene monomer rubber, natural rubber, ethylene propylene diene monomer rubber, ethylene vinyl acetate rubber, hydrogenised acrylonitrile-butadiene rubber, acrylonitrile butadiene rubber, isoprene rubber, chloroprene rubber, or polynorbornene. While the specific chemistry is of no limitation to the present disclosure, swellable compositions commonly used in downhole environments include swellable elastomers.

Illustrative degradable materials may be made from metals (e.g., calcium, magnesium, aluminum, and their alloys), polymeric materials, or plastic materials. Polymeric materials may be or include water-soluble or oil-soluble polymers or combinations thereof. Examples of water-soluble polymers include (a) polyesters such as polylactic acid (PLA), polyglycolic acid (PGA), poly(caprolactone), (b) polyanhydrides, (c) polycarbonates, (d) polyurethanes, (e) polysaccharides, (f) polyethers such as poly(ethylene oxide), and combinations or copolymers thereof. Examples of oil-soluble polymers polymers include (a) polyolefins such as polyisobutylenes, (b) polyethers such as polybutylene oxides and combinations or copolymers thereof. In addition, composites of degradable polymeric with other degradable or non-degradable materials may be employed to enhance the mechanical properties of the polymeric degradable member. Examples of non-polymeric additives include metals, carbon fibers, clays, non-degradable polymers, etc. The degradable material may be a composite of several materials, or include layers or coatings of different materials. The fluid that causes the degradable material to degrade or dissolve may be or include water, formation fluid (e.g., hydrocarbons), a polar solvent, a non-polar solvent, gravel pack carrier fluid, an additive that is pumped downhole, or a combination thereof. The degradable material may include various combinations of aluminum, magnesium, gallium, indium, bismuth, silicon and zinc. In one particular example, the degradable material may be an aluminum alloy including about 0.5 wt % to about 8.0 wt % Ga, about 0.5 wt % to about 8.0 wt % Mg, less than about 2.5 wt % In, and less than about 4.5 wt % Zn. In some embodiments, the degradable material may include an outer coating that is degradable in contact with one fluid or additive and an inner layer that is degradable in contact with another fluid or additive. In some embodiments, degradation may be achieved by spotting a fluid with which at least a portion of the degradable material interacts with to promote degradation.

The predetermined amount of time may be chosen to be after gravel packing takes place but before production takes place. Thus, the predetermined amount of time may be less than about 24 hours, less than 3 days, less than 1 week, less than 2 weeks, less than one month, or more than one month. The rate that the first swellable or degradable member 232 swells or degrades may depend, at least partially, upon the type or composition of first swellable or degradable member 232, the type of the first fluid, the time in contact with the first fluid, the temperature of the first fluid, the pressure of the first fluid, the pH of the first fluid, the surface area of the first swellable or degradable member 232 in contact with the first fluid, or a combination thereof.

Once in contact with the first fluid for the predetermined amount of time, the first swellable or degradable member 232 may at least partially swell or degrade sufficiently to release the shaft 230 therefrom. In another embodiment, the shaft 230 may be swellable or degradable in response to contact with the first fluid. The first biasing member 234 may then expand and push the valve 220 toward the openings 212 in the intermediate tubular member 210 (to the left, as shown in FIG. 4), thereby actuating the valve system 200 into the second position. In the second position, the openings 224 in the valve 220 may be at least partially aligned with the openings 212 in the intermediate tubular member 210. Additionally, an outer surface 226 on the valve 220 may be in contact with (e.g., stabbed into) an inner surface 216 of the intermediate tubular member 210. One or more elastomeric devices (e.g., O-rings) 228 may be positioned around the valve 220 to facilitate a seal between the valve 220 and the intermediate tubular member 210.

Although the first biasing member 234 is shown as a spring in the Figures, it will be appreciated that other sources of potential energy may be used instead of, or in addition to, a spring. For example, a compressed fluid may be released in response to the swelling or degradation of the first swellable or degradable material 232 to propel the valve 220 within the intermediate tubular member 210.

Figure 5:
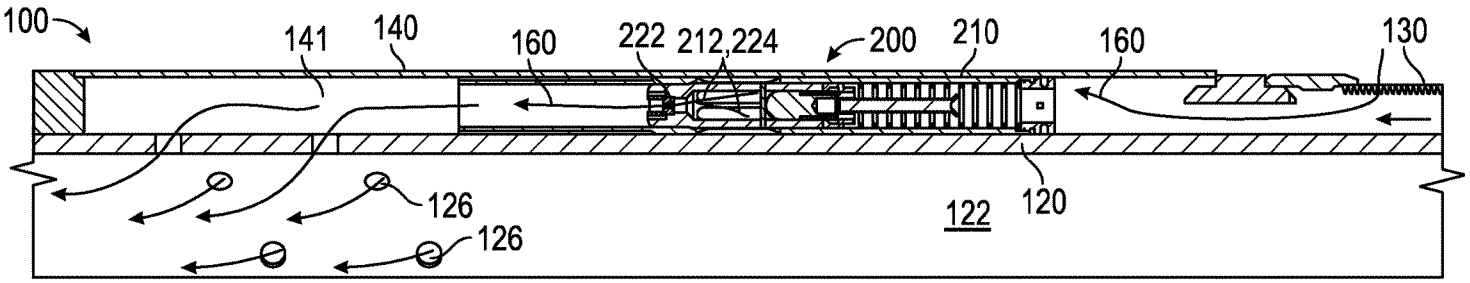
FIG. 5 depicts a partial cross-sectional view of the downhole tool showing the valve system in the second position, according to one or more embodiments disclosed.

FIG. 5 depicts a partial cross-sectional view of the downhole tool 100 showing the valve system 200 in the second position, according to one or more embodiments disclosed. Once the valve system 200 moves into the second position, the flowpath 160 may still exist from housing annulus 141, into the intermediate tubular member 210 through the openings 212 in the intermediate tubular member 210, and into the base pipe 120 through the openings 126 in the base pipe 120. However, the flowpath 160 may now extend at least partially through the valve 220 (e.g., into the opening 224 in the valve 220 and through the flow control device 222).

Thus, production fluid (e.g., hydrocarbons) from the formation may flow through the screen 130, through the flowpath 160, into the base pipe 120, and up to the surface. The flow control device 222 may change a proportion of the fluid that flows through the screen 130 that flows through the flow control device 222. In other words, the flow control device 222 may change the volumetric flow rate through the flowpath 160 from the screen 130 to the openings 126. For example, the amount (e.g., volumetric rate) of fluid that may flow through the flowpath 160 when the valve system 200 is in the second position may be less than or equal to about 50% of the amount of fluid that may flow through the flowpath 160 when the valve system 200 is in the first position. Placing the flow control device 222 in the flowpath 160 may allow additional openings and/or flow control devices in the base pipe 120 to be omitted.

Figure 6:
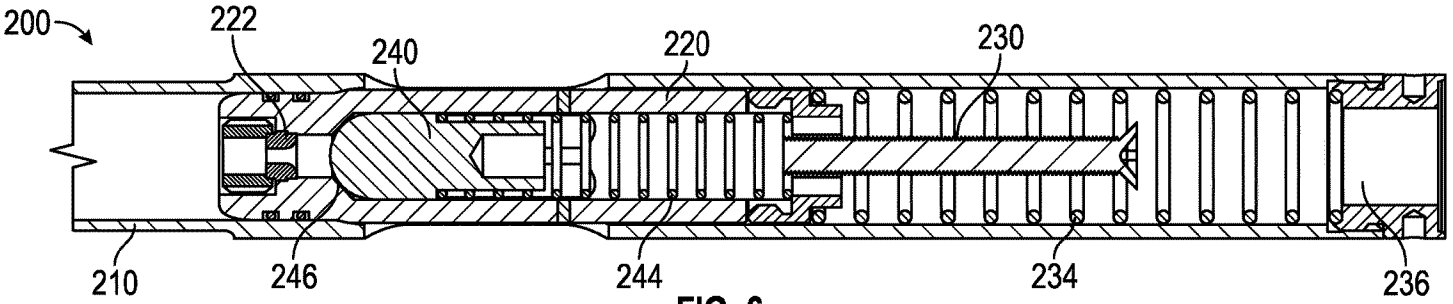
FIG. 6 depicts a cross-sectional view of the valve system in a third position, according to one or more embodiments disclosed.

FIG. 6 depicts a cross-sectional view of the valve system 200 in a third position, according to one or more embodiments disclosed. The second swellable or degradable member 242 (see FIG. 4) may be configured to swell or degrade in response to contact with a second fluid that is different than the first fluid (which causes the first swellable or degradable member 232 to swell or degrade). In one illustrative example, the second swellable or degradable member 242 may be made from carbonate, and the second fluid may be or include a chelant.

Once in contact with the second fluid for a predetermined amount of time, the second swellable or degradable member 242 may at least partially swell or degrade. When the second swellable or degradable member 242 swells or degrades sufficiently, the second biasing member 244 may expand and push the body 240 within the valve 220 (to the left, as shown in FIG. 6) to actuate the valve system 200 into the third position. In the third position, the body 240 may substantially obstruct or prevent fluid flow through the flowpath 160. More particularly, the plug 246 of the body 240 may contact or otherwise prevent fluid flow through the flow control device 222. For example, the amount (e.g., volumetric rate) of fluid that may flow through the flowpath 160 when the valve system 200 is in the third position may be less than or equal to about 10% of the amount of fluid that may flow through the flowpath 160 when the valve system 200 is in the second position. In at least one embodiment, the body 240 may be omitted, and the valve system 200 may actuate between the three positions by virtue of movement of a single valve (e.g., the valve 220).

Although the second biasing member 244 is shown as a spring in the Figures, it will be appreciated that other sources of potential energy may be used instead of, or in addition to, the a spring. For example, a compressed fluid may be released in response to the swelling or degradation of the second swellable or degradable material 242 to propel the body 240 within the intermediate tubular member 210.

Figure 7:
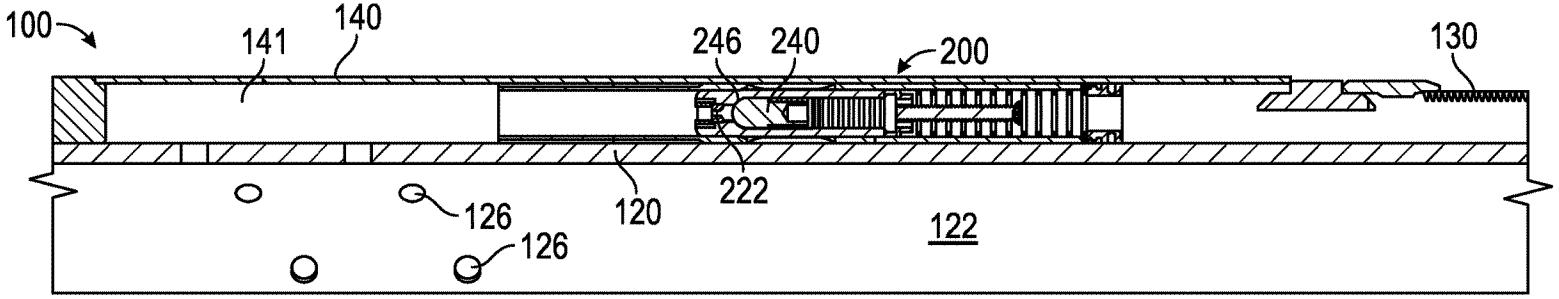
FIG. 7 depicts a partial cross-sectional view of the downhole tool showing the valve system in the third position, according to one or more embodiments disclosed.

FIG. 7 depicts a partial cross-sectional view of the downhole tool 100 showing the valve system 200 in the third position, according to one or more embodiments disclosed. An operator at the surface location may cause the valve system 200 to actuate from the second position to a third position. For example, the operator may cause the valve system 200 to actuate into the third position in response to a predetermined amount of water (i.e., "watercut") or other undesirable fluid flowing from the formation through the valve system 200 and into the base pipe 120.

To actuate the valve system 200 into the third position, a coiled tubing or tractor may introduce (e.g., "spot") the second fluid proximate to the valve system 200. For example, the coiled tubing or tractor may introduce the second fluid into the base pipe 120 proximate to the openings 126 in the base pipe 120. The second fluid may flow through the openings 126 in the base pipe 120 and contact the second swellable or degradable member 242 (see FIG. 4). As discussed above, this may cause the body 240 to move toward the flow control device 222 to substantially obstruct or prevent fluid flow through the valve system 200. A latch may be used to secure the valve 220 in place when the second fluid flows through the openings 126 in the base pipe 120 and through the inflow control device 222.

Although a single valve system 200 is shown in the downhole tool 100, it will be appreciated that the downhole tool 100 may include a plurality of valve systems 200. In this instance, the valve systems 200 may be selectively moved into the third position by the operator at least partially based on the composition of the fluid (e.g., hydrocarbon, water, etc.) flowing therethrough. For example, a valve system 200 having fluid that is 60% water and 40% hydrocarbon flowing therethrough may be actuated into the third position while a valve system 200 having fluid that is 20% water and 80% hydrocarbon flowing therethrough may be left in the second position.

Figure 8:
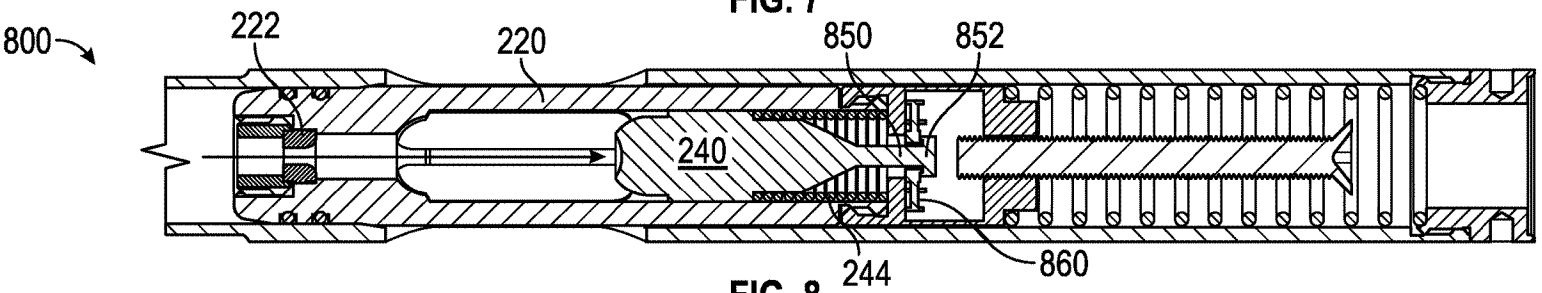
FIG. 8 depicts a cross-sectional view of another illustrative valve system in the second position.
Figure 9:
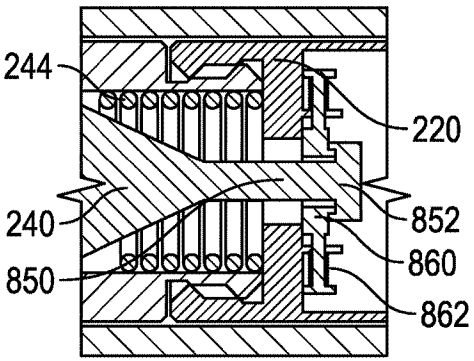
FIG. 9 depicts an enlarged cross-sectional view of a portion of the valve system of FIG. 8 in the second position, according to one or more embodiments disclosed.

FIG. 8 depicts a cross-sectional view of another illustrative valve system 800 in the second position, and FIG. 9 depicts an enlarged cross-sectional view of a portion of the valve system 800 in the second position, according to one or more embodiments disclosed. The valve system 800 in FIGS. 8 and 9 may be similar to the valve system 200 described above with reference to FIGS. 1-7, and similar reference numbers are used to identify similar components in FIGS. 8 and 9.

The body 240 may include a tail 850 extending axially therefrom. An end of the tail 850 may include a hook 852. Rather than the second swellable or degradable member 242, the body 240 may be held in place by one or more retaining mechanisms (two are shown) 860 when the valve system 800 is in the first and/or second position. More particularly, the hook 852 of the body 240 may be engaged with the retaining mechanisms 860 to hold the body 240 in place.

The retaining mechanisms 860 may be movably coupled to the valve 220. Each retaining mechanism 860 may include a biasing member (e.g., a spring) 862 that exerts a force on the retaining mechanism 860. As shown, the biasing members 862 may exert a force on the retaining mechanisms 860 in a radially-outward direction. The biasing members 862 may be held in a compressed state when the hook 852 is engaged with the retaining mechanisms 860.

Figure 10:
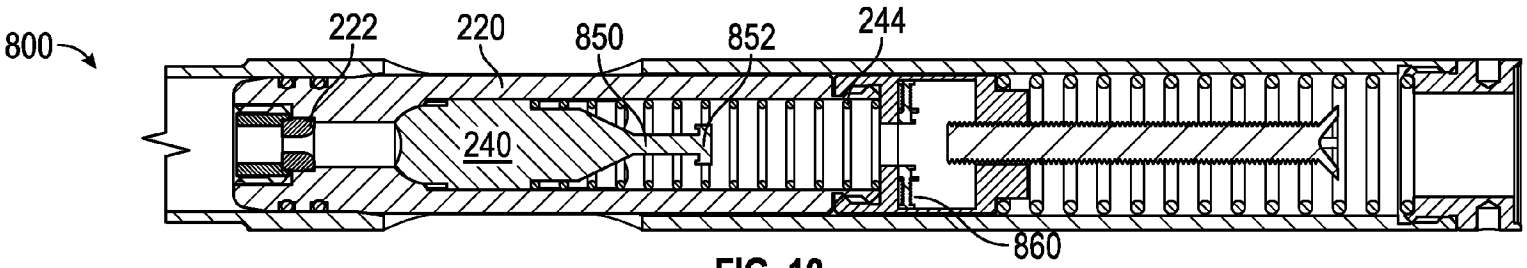
FIG. 10 depicts a cross-sectional view of the valve system of FIG. 8 in the third position.
Figure 11:
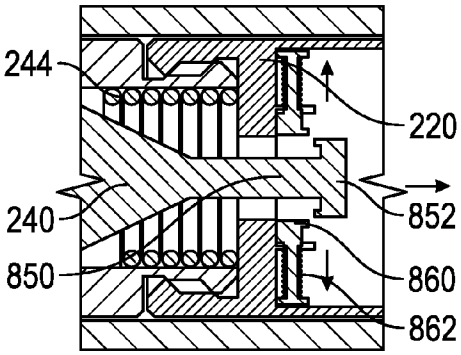
FIG. 11 depicts an enlarged cross-sectional view of a portion of the valve system of FIG. 8 moving into the third position, according to one or more embodiments disclosed.

FIG. 10 depicts a cross-sectional view of the valve system 800 in the third position, and FIG. 11 depicts an enlarged cross-sectional view of the valve system 800 moving into the third position, according to one or more embodiments disclosed. The operator at the surface location may cause the valve system 800 to actuate from the second position to the third position. For example, the operator may pump fluid into the base pipe 120. The fluid may flow through the openings 126 in the base pipe 120 and through the flow control device 222 toward the body 240. As the fluid flows through the flow control device 222, the kinetic energy and velocity of the fluid may be increased. This may exert a force on the body 240 that moves the body 240 away from the inflow control device 222 (e.g., to the right, as shown in FIGS. 10 and 11), thereby further compressing the second biasing member 244. As discussed above, a latch may be used to secure the valve 220 in place as the fluid flows through the flow control device 222.

The movement of the body 240 may cause the hook 852 to disengage the retaining mechanisms 860. Once disengaged, the biasing members 862 may cause the retaining mechanisms 860 to move radially-outward. The operator may then reduce or cut off the fluid flow into the base pipe 120, thereby reducing the force exerted on the body 240 by the fluid. When the force exerted on the body 240 by the second biasing member 244 becomes greater than the opposing force exerted by the fluid, the body 240 may move toward the flow control device 222 to prevent fluid flow through the flow control device 222, thus actuating the valve system 800 into the third position. As the retaining mechanisms 860 have moved radially-outward, they may not engage the hook 852 to prevent the body 240 from moving toward the flow control device 222.

Figure 12:
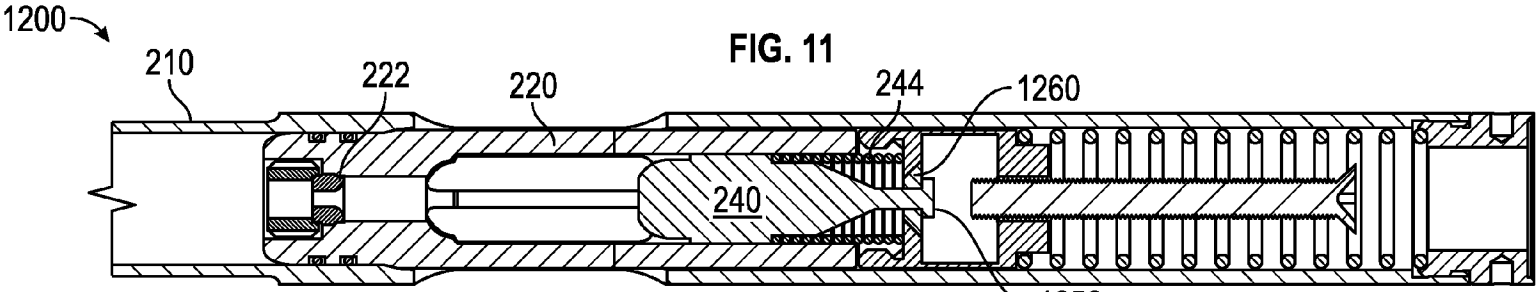
FIG. 12 depicts a cross-sectional view of yet another illustrative valve system in the second position.
Figure 13:
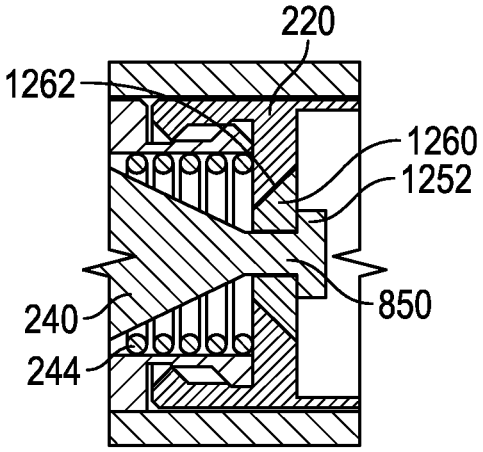
FIG. 13 depicts an enlarged cross-sectional view of a portion of the valve system of FIG. 12 in the second position, according to one or more embodiments disclosed.

FIG. 12 depicts a cross-sectional view of another illustrative valve system 1200 in the second position, and FIG. 13 depicts an enlarged cross-sectional view of a portion of the valve system 1200 in the second position, according to one or more embodiments disclosed. The valve system 1200 in FIGS. 12 and 13 may be similar to the valve system 200, 800 described above with reference to FIGS. 1-11, and similar reference numbers are used to identify similar components in FIGS. 12 and 13.

An upset 1252 on the tail 850 of the body 240 may be engaged with retaining mechanisms (two are shown) 1260 to hold the body 240 in place when the valve system 1200 is in the first and/or second position. The retaining mechanisms 1260 may be positioned between and/or in contact with the valve 220 and the upset 1252 of the body 240. The retaining mechanisms 1260 in FIGS. 12 and 13 may not include biasing members 862 (see FIGS. 8-11). Rather, the retaining mechanisms 1260 may be wedge-shaped and include an inclined surface 1262 that is oriented at an angle from about 10° to about 80°, about 20° to about 70°, or about 30° to about 60° with respect to the central longitudinal axis through the tubular member 210.

Figure 14:
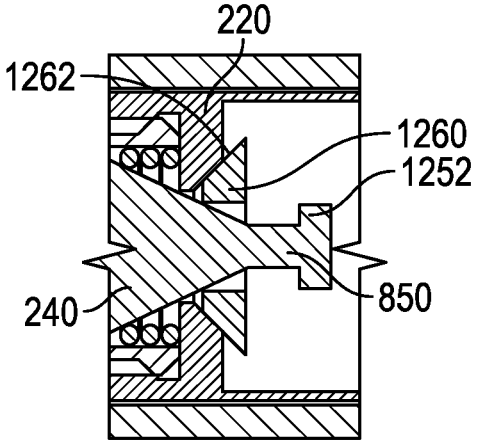
FIGS. 14 and 15 depict enlarged cross-sectional views of the portion of the valve system of FIG. 12 showing movement from the second position to the third position, according to one or more embodiments disclosed.
Figure 15:
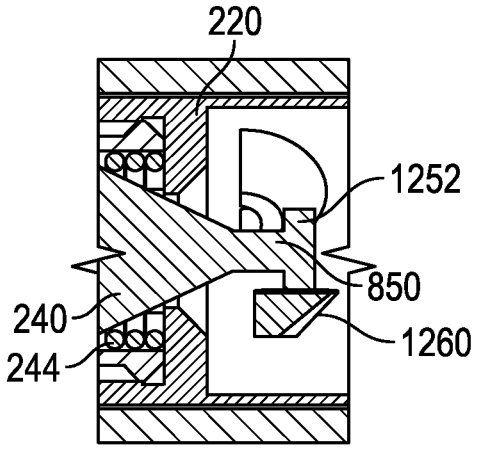

FIGS. 14 and 15 depict enlarged cross-sectional views of the portion of the valve system 1200 showing movement from the second position to the third position, according to one or more embodiments disclosed. The operator at the surface location may cause the valve system 1200 to actuate from the second position to a third position. For example, the operator may pump fluid into the base pipe 120. The fluid may flow through the openings 126 in the base pipe 120 and through the flow control device 222 toward the body 240. As the fluid flows through the flow control device 222, the kinetic energy and velocity of the fluid may be increased. This may exert a force on the body 240 that moves the body 240 away from the flow control device 222 (e.g., to the right, as shown in FIGS. 14 and 15), thereby further compressing the second biasing member 244. As discussed above, a latch may be used to secure the valve 220 in place as the fluid flows through the flow control device 222.

The body 240 may contact the retaining mechanisms 1260 as the body 240 moves away from the flow control device 222. This may cause the inclined surfaces 1262 of the retaining mechanisms 1260 to move or slide along the corresponding surfaces of the valve 220, as shown in FIG. 14. As the body 240 and the retaining mechanisms 1260 continue to move, the retaining mechanisms 1260 may fall free of the upset 1252, as shown in FIG. 15. Although not shown, in at least one embodiment, a biasing member (e.g., a spring) may be incorporated to eject the retaining mechanisms 1260. The biasing member may be coupled to the valve 220 or the body 240.

Figure 16:
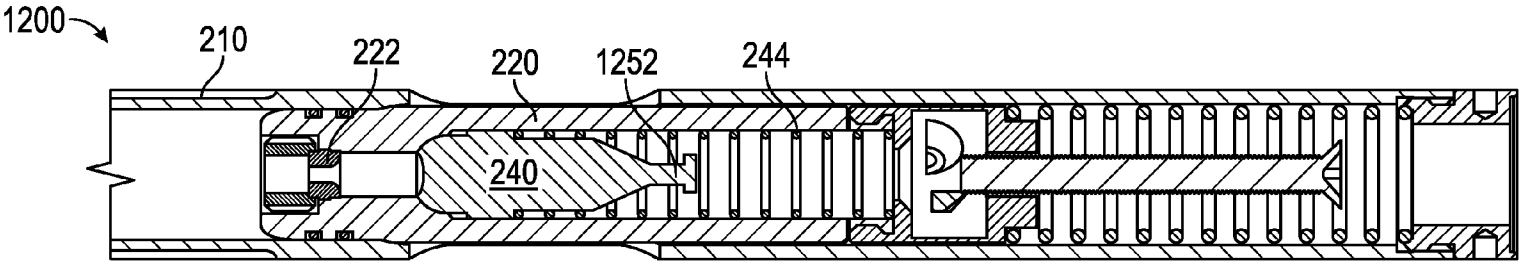
FIG. 16 depicts a cross-sectional view of the valve system of FIG. 12 in the third position, according to one or more embodiments disclosed.

FIG. 16 depicts a cross-sectional view of the valve system 1200 in the third position, according to one or more embodiments disclosed. The operator may reduce or cut off the fluid flow into the base pipe 120, thereby reducing the force exerted on the body 240 by the fluid. When the force exerted on the body 240 by the second biasing member 244 becomes greater than the opposing force exerted by the fluid, the body 240 may move toward the inflow control device 222 to prevent fluid flow through the flow control device 222, thus actuating the valve system 1200 into the third position. As the retaining mechanisms 1260 are no longer positioned between the valve 220 and the upset 1252 of the body 240, they may not engage the upset 1252 to prevent the body 240 from moving toward the flow control device 222.

Figure 17:
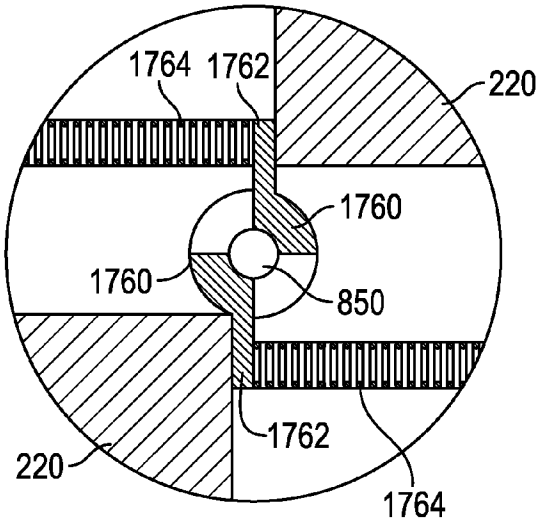
FIG. 17 depicts an end view of the valve system having different retaining mechanisms than those shown in FIGS. 12-16, according to one or more embodiments disclosed.

FIG. 17 depicts an end view of the valve system 1200 having different retaining mechanisms 1760 than those shown in FIGS. 12-16, according to one or more embodiments disclosed. The retaining mechanisms 1760 may be positioned radially-outward from the tail 850 of the body 240. As shown, the retaining mechanisms 1760 may be circumferentially-offset from one another around the tail 850. The retaining mechanisms 1760 may each include a tab 1762 that extends radially-outward therefrom. The tabs 1762 may be positioned between the valve 220 and a biasing member 1764 when the valve system 1200 is in the first position and/or the second position. The biasing members 1764 may be compressed when the valve system 1200 is in the first position and/or the second position.

When the operator pumps fluid into the base pipe 120 to move the body 240 axially within the valve 220, as discussed above (e.g., moving out of the page, according to the orientation shown in FIG. 17), the tabs 1762 may move out of contact with the valve 220. As such, the biasing members 1764 may expand, thereby ejecting the retaining mechanisms 1760 away from the tail 850. When this occurs, the retaining mechanisms 1760 are no longer present to restrict the movement of the body 240 as the body 240 moves. As such, the valve 1200 may move into the third position.

Figure 18:
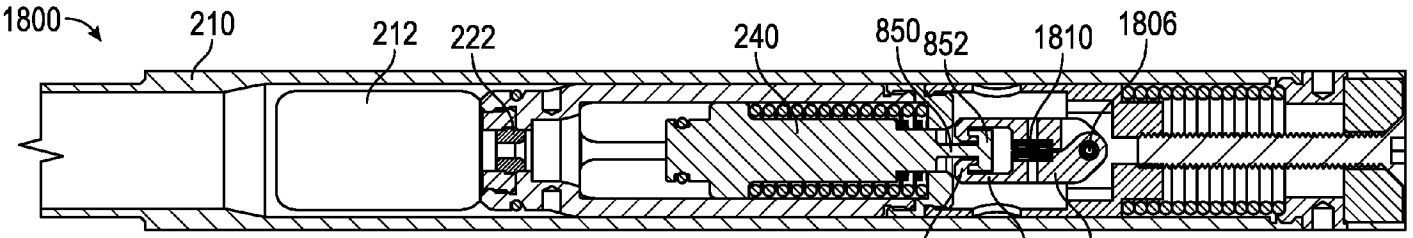
FIG. 18 depicts a cross-sectional view of another illustrative valve system in the first position, according to one or more embodiments disclosed.

FIG. 18 depicts a cross-sectional view of another illustrative valve system 1800 in the first position, according to one or more embodiments disclosed. The valve system 1800 may include a retaining mechanism 1802 in the form of a clasp having one or more arms 1804 that are configured to pivot around a hinge 1806. The arms 1804 may include hooks 1808 that are configured to engage corresponding hooks 852 on the tail 850 of the body 240 when the valve system 1800 is in the first position. A biasing member 1810 may be in contact with the arms 1804. As shown, the biasing member 1810 is positioned between the arms 1804 and exerts a force on the arms 1804 in an outward direction.

Figure 19:
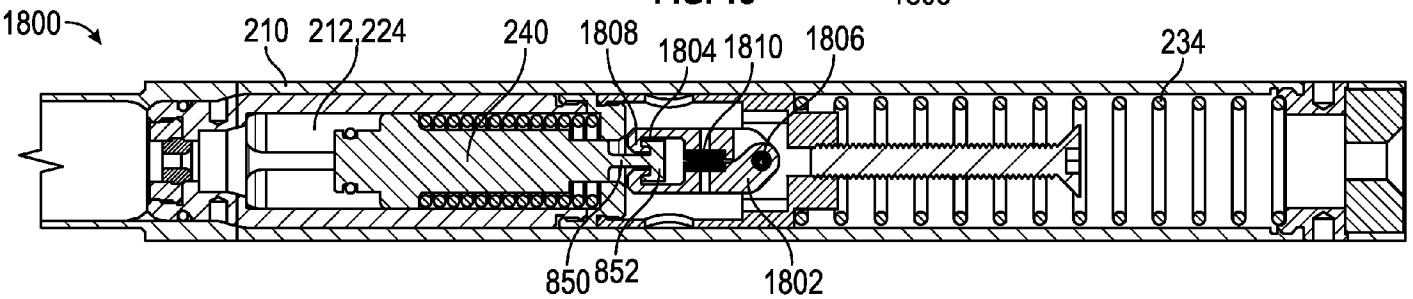
FIG. 19 depicts a cross-sectional view of the valve system of FIG. 18 in the second position, according to one or more embodiments disclosed.
Figure 20:
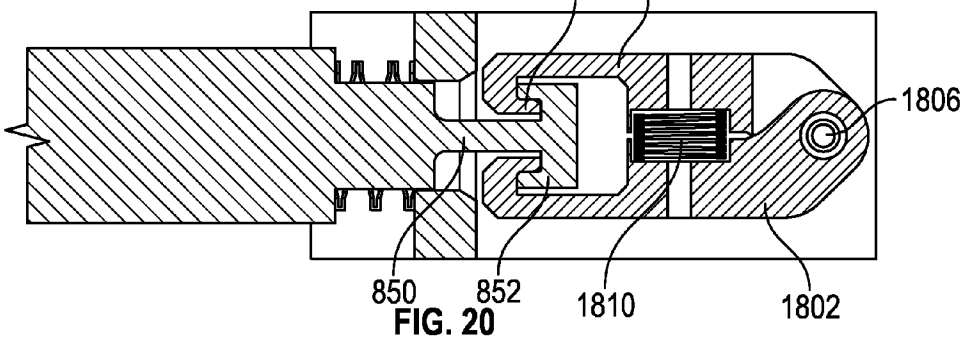
FIG. 20 depicts an enlarged cross-sectional view of a portion of the valve system of FIG. 19 (in the second position), according to one or more embodiments disclosed.

FIG. 19 depicts a cross-sectional view of the valve system 1800 of FIG. 18 in the second position, and FIG. 20 depicts an enlarged cross-sectional view of an enlarged portion of the valve system 1800 of FIG. 19 (in the second position), according to one or more embodiments disclosed. The hooks 1808 of the retaining mechanism 1802 may remain engaged with the hooks 852 of the body 240 when the valve system 1800 is in the second position. As such, the biasing member 1810 may remain compressed.

Figure 21:
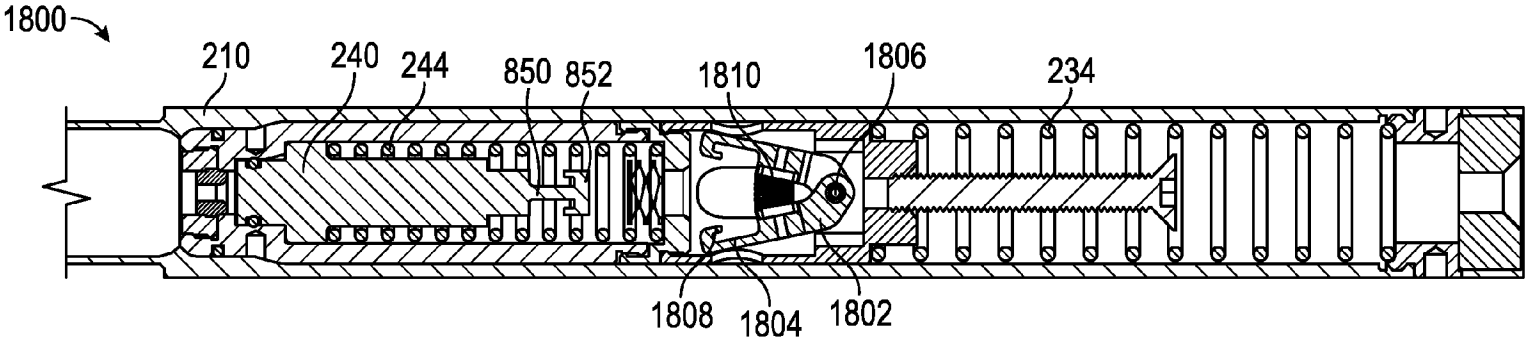
FIG. 21 depicts a cross-sectional view of the valve system of FIG. 18 in the third position, according to one or more embodiments disclosed.
Figure 22:
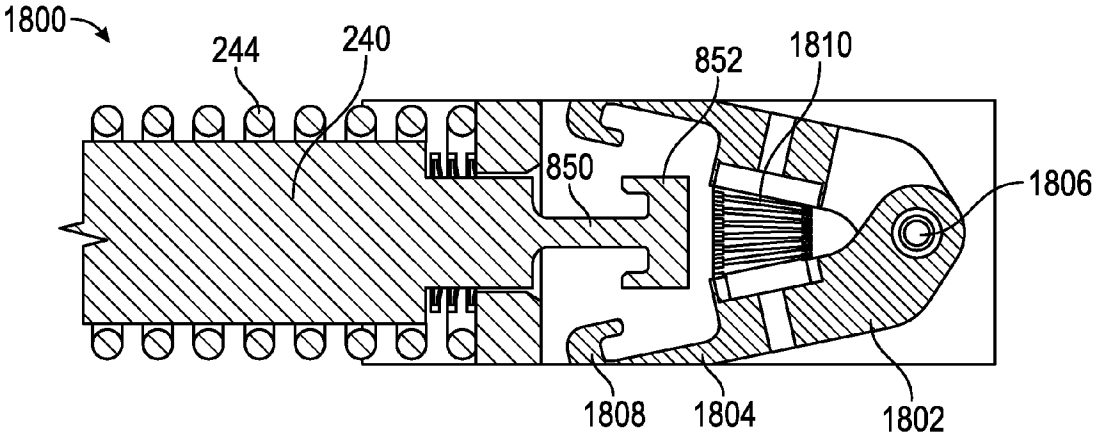
FIG. 22 depicts an enlarged cross-sectional view of a portion of the valve system of FIG. 21 (in the third position), according to one or more embodiments disclosed.

FIG. 21 depicts a cross-sectional view of the valve system of FIG. 18 in the third position, and FIG. 22 depicts an enlarged cross-sectional view of an enlarged portion of the valve system of FIG. 21 (in the third position), according to one or more embodiments disclosed. When the operator pumps the fluid into the base pipe 120 causing the body 240 to move within the valve 220 (e.g., to the right, as shown in FIGS. 21 and 22), the hooks 1808 of the retaining mechanism 1802 may disengage the hooks 852 of the body 240. Once this occurs, the biasing member 1810 may cause the arms 1804 to expand about the hinge 1806, as shown. Thus, when the operator reduces the flow into the base pipe 120, the hooks 852 of the body 240 are no longer present to restrict the movement of the body 240 as the body 240 moves (e.g., to the left, as shown in FIGS. 21 and 22). As such, the valve 1800 may move into the third position.

Figure 23:
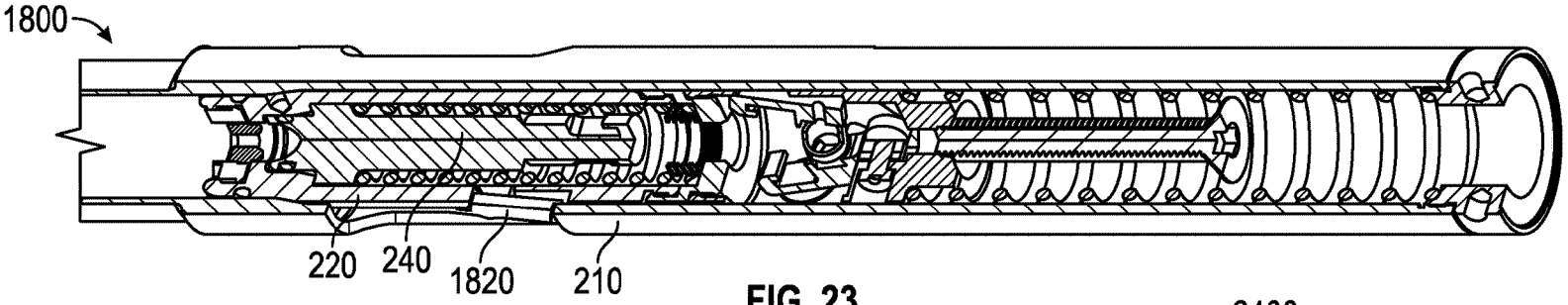
FIG. 23 depicts a quarter cross-section of a perspective view of the valve system of FIGS. 21 and 22 (in the third position), according to one or more embodiments disclosed.

FIG. 23 depicts a quarter cross-section of a perspective view of the valve system 1800 of FIGS. 21 and 22 (in the third position), according to one or more embodiments disclosed. The valve 220 may include a latch 1820 that is coupled to the valve 220 by a hinge. The latch 1820 may be spring-loaded and expand to engage a recess or shoulder in the intermediate tubular member 210, the base pipe 120, or the housing 140 when the valve system 1800 moves into the second position. When the operator pumps the fluid into the base pipe 120, the fluid exerts a force on the valve 220 and the body 240 (e.g., to the right, as shown in FIG. 23). While this force may cause the body 240 to move within the intermediate tubular member 210, the engagement between the latch 1820 and the intermediate tubular member 210 may prevent the valve 220 from moving (e.g., to the right, as shown in FIG. 23).

Figure 24:
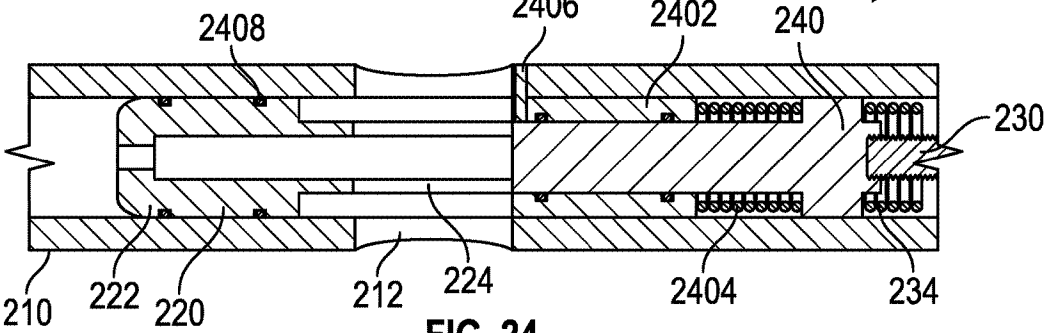
FIGS. 24 and 25 depict cross-sectional views of another illustrative valve system in the second position, according to one or more embodiments disclosed.
Figure 25:
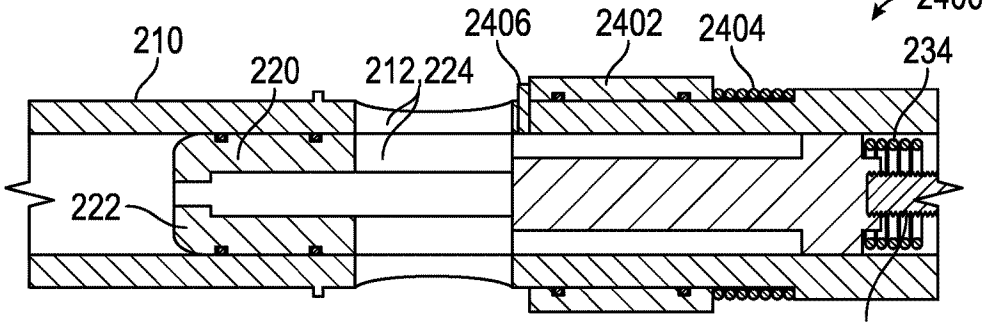

FIGS. 24 and 25 depict cross-sectional views of another illustrative valve system 2400 in the second position, according to one or more embodiments disclosed. In contrast to the embodiments above that obstruct the flow through the flow control device 222 using the second valve 240, the valve system 2400 in FIGS. 24 and 25 obstructs the flow through the flow control device 222 using a sliding sleeve 2402. The sleeve 2400 is shown positioned radially-between the valve 220 and the intermediate tubular member 210 in FIG. 24, and the sleeve 2400 is shown positioned radially-outward from the intermediate tubular member 210 in FIG. 25.

A biasing member 2404 may be positioned on one axial side of the sleeve 2402. The biasing member 2404 may exert an axial force on the sleeve 2402 in the direction of the openings 224 in the valve 220 (e.g., to the left, as shown in FIGS. 24 and 25). A swellable or degradable member 2406 may be coupled to or in contact with the sleeve 2402 to oppose the force exerted by the biasing member 2404 and hold the sleeve 2402 in place. As shown, the swellable or degradable member 2406 may be positioned on the other axial side of the sleeve 2402 from the biasing member 2404. In other embodiments, the swellable or degradable member 2406 may extend at least partially into or through the sleeve 2402 at any point along the length of the sleeve 2402.

The swellable or degradable member 2406 may prevent the sleeve 2402 from moving toward the openings 224 in the valve 220 when the valve system 2400 is in the first and/or second position. When the swellable or degradable member 2406 swells or degrades, the biasing member 2404 may cause the sleeve 2402 to move such that it is axially-aligned with, and obstructs fluid flow through, the openings 224 in the valve 220, thereby actuating the valve system 2400 into the third position. The sleeve 2402 may include one or more elastomeric devices (e.g., O-rings) 2408 positioned around the inner or outer surface thereof to facilitate a seal between the sleeve 2402 and the tubular member 210 or the valve 220.

Figure 26:
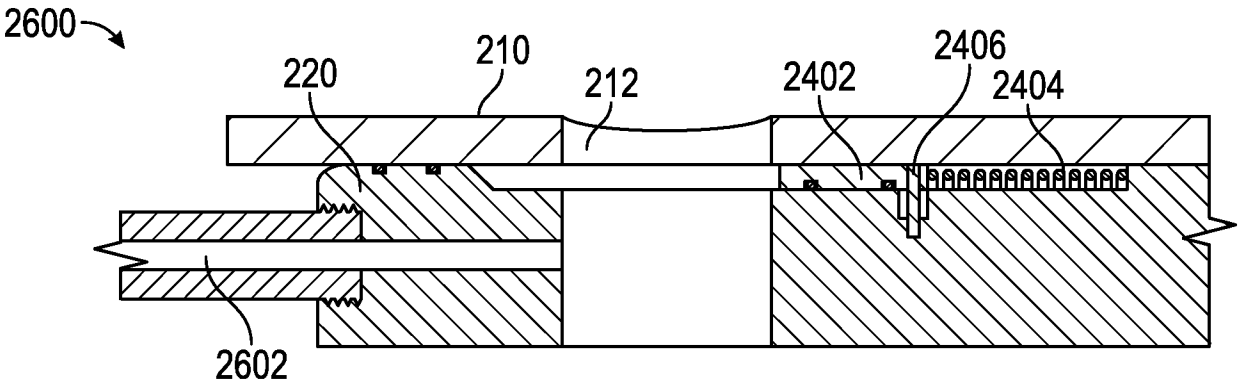
FIGS. 26 and 27 depict cross-sectional views of yet another illustrative valve system in the second position, according to one or more embodiments disclosed.
Figure 27:
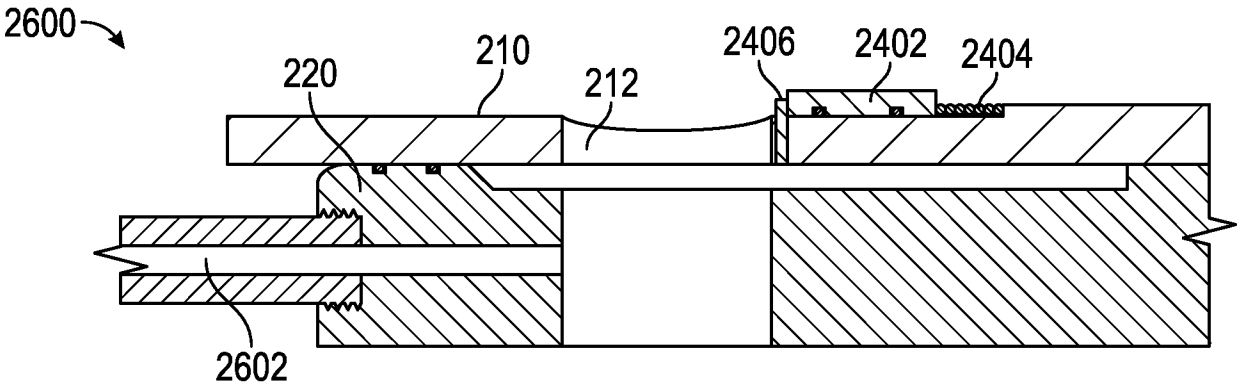

FIGS. 26 and 27 depict cross-sectional views of yet another illustrative valve system 2600 in the second position, according to one or more embodiments disclosed. As with FIGS. 24 and 25, the sleeve 2402 is shown positioned radially-between the valve 220 and the intermediate tubular member 210 in FIG. 26, and the sleeve 2402 is shown positioned radially-outward from the intermediate tubular member 210 in FIG. 27. In contrast to the embodiments shown in FIGS. 24 and 25 that use a nozzle as the flow control device 222, the valve system 2600 in FIGS. 26 and 27 uses a friction pressure-loss tube 2602 as the flow control device.

The pressure-loss tube 2602 may restrict the fluid flow through the valve system 2600 when the valve system 2600 is in the second position. The pressure-loss tube 2602 may be coupled to and/or in fluid communication with the openings 224 in the valve 220. The pressure-loss tube 2602 may have a length from about 1 cm to about 50 cm, about 2 cm to about 25 cm, or about 3 cm to about 10 cm. The flow path through the pressure-loss tube 2602 may have a cross-sectional area from about 1 $mm^2$ to about 50 $mm^2$, about 2 $mm^2$ to about 25 $mm^2$, or about 3 $mm^2$ to about 10 $mm^2$.

In at least one embodiment, a method for gravel packing a wellbore may include degrading a degradable member (e.g., member 232) in the downhole tool 100. The downhole tool 100 may include a screen 130, a valve system 200, and a flow control device 222. The valve system 200 may include a valve 220. The valve 220 may move with respect to the screen 130 in response to the degradable member 232 at least partially degrading. The valve 220 may cause or direct at least a portion of the fluid that flows through the screen 130 to flow through the flow control device 222 after the valve 220 moves. The wellbore may be gravel packed before the valve system 200 is actuated. The wellbore may be produced after the valve system 200 is actuated. The downhole tool 100 may be run into the wellbore in a fluid that does not degrade the degradable member 232. For example, the fluid may be an oil-based fluid or a water-based fluid. The fluid that causes the degradable member 232 to degrade may be a gravel packing fluid, a spacer fluid, an oil-based fluid, or a water-based fluid. In one example, the downhole tool 100 may be run into the wellbore in a first fluid, and the wellbore may be gravel packed with a second fluid. One of the first fluid and the second fluid may be an oil-based fluid, and the other of the first fluid and the second fluid may be a water-based fluid.

As used herein, the terms "inner" and "outer"; "up" and "down"; "upper" and "lower"; "upward" and "downward"; "above" and "below"; "inward" and "outward"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

Although the preceding description has been described herein with reference to particular means, materials, and embodiments, it is not intended to be limited to the particulars disclosed herein; rather, it extends to all functionally equivalent structures, methods, and uses, such as are contemplated within the scope of the appended claims. While the foregoing is directed to embodiments of the present invention, other and further embodiments of the invention may be devised without departing from the basic scope thereof.

What is claimed is:

1. A downhole tool, comprising:

a housing comprising a screen; and a valve system positioned within the housing, the valve system comprising a first valve and a flow control device, wherein the valve system has a first position where the first valve allows a flow within the housing, a second position where the first valve directs at least a portion of the flow through the flow control device, and a third position stopping flow through the flow control device; and wherein the valve system further comprises an intermediate tubular member positioned between the housing and a base pipe, wherein the intermediate tubular member has a first opening formed radially-therethrough.

2. The downhole tool of claim 1, wherein the first valve includes a body therein that actuates the valve system to the third position, or the valve system comprises a second valve, and movement of the second valve actuates the valve system to the third position.

3. The downhole tool of claim 1, wherein the valve system further comprises a first degradable member configured to at least partially degrade in response to contact with a first fluid, and wherein the valve system is configured to actuate from the first position to the second position in response to the first degradable member at least partially degrading.

4. The downhole tool of claim 3, wherein the valve system further comprises a second degradable member configured to at least partially degrade in response to contact with a second fluid that is different from the first fluid, and wherein the valve system is configured to actuate from the second position to the third position in response to the second degradable member at least partially degrading.

5. The downhole tool of claim 1, wherein the first valve is positioned at least partially in the intermediate tubular member, wherein the first valve has an axial bore formed at least partially therethrough, and wherein a second opening is formed radially-through the first valve.

6. The downhole tool of claim 5, wherein the flow control device is positioned within the bore.

7. The downhole tool of claim 5, wherein the valve system further comprises a first biasing member, wherein the first opening is offset from the second opening when the valve system is in the first position, and wherein the first biasing member moves the first valve within the intermediate tubular member such that the first opening is aligned with the second opening when the valve system is in the second position.

8. The downhole tool of claim 7, wherein the valve system further comprises a body and a second biasing member, each positioned at least partially within the first valve, and wherein the second biasing member moves the body within the first valve to stop flow through the flow control device as the valve system actuates from the second position to the third position.

9. The downhole tool of claim 8, wherein the valve system further comprises a retaining mechanism configured to hold the body in place when the valve system is in the first position, the second position, or both, and wherein the retaining mechanism disengages the body in response to fluid flowing through the flow control device and toward the screen, thereby allowing the valve system to actuate into the third position.

10. The downhole tool of claim 9, wherein the retaining mechanism comprises a hook configured to engage a corresponding hook on the body when the valve system is in the first position, the second position, or both positions.

11. A downhole tool, comprising:

a housing comprising a screen;

an inner tubular member positioned radially-inward from the housing such that an annulus is formed therebetween, wherein a first opening is formed radially-through the inner tubular member; and a valve system positioned within the annulus, wherein the valve system comprises:

an intermediate tubular member having a second opening formed radially-therethrough a first valve positioned at least partially in the intermediate tubular member, wherein the first valve has an axial bore formed at least partially therethrough, and wherein a third opening is formed radially-through the first valve;

a flow control device positioned within the axial bore; and a first degradable member configured to at least partially degrade in response to contact with a first fluid, wherein the valve system has a first position where the first valve allows a flow within the housing, a second position where the first valve directs at least a portion of the flow through the flow control device, and a third position stopping flow through the flow control device.

12. The downhole tool of claim 11, wherein the valve system further comprises a second degradable member configured to at least partially degrade in response to contact with a second fluid that is different than the first fluid, wherein the valve system is configured to actuate from the second position to the third position in response to the second degradable member at least partially degrading.

13. The downhole tool of claim 11, wherein the second opening is offset from the third opening when the valve system is in the first position, and wherein the second opening is aligned with the third opening when the valve system is in the second position.

14. The downhole tool of claim 11, wherein the valve system further comprises a body positioned at least partially within the first valve, and wherein a biasing member moves the body within the first valve to stop flow through the flow control device as the valve system actuates from the second position to the third position.

15. The downhole tool of claim 14, wherein the valve system further comprises a retaining mechanism configured to hold the body in place when the valve system is in the first position, the second position, or both, and wherein the retaining mechanism disengages the body in response to fluid flowing from the first opening, in through the flow control device, and toward the screen, thereby allowing the valve system to actuate into the third position.

16. A method for gravel packing a wellbore, comprising:

degrading a degradable member in a downhole tool, wherein the downhole tool comprises a screen, a valve system, and a flow control device, and wherein the valve system comprises a first valve;

moving the first valve in response to the degradable member at least partially degrading; and directing at least a portion of a fluid that flows through the screen to flow through the flow control device with the first valve after the first valve moves.

wherein the downhole tool further comprises:

a housing comprising a screen; and an inner tubular member positioned radially-inward from the housing such that an annulus is formed therebetween, wherein a first opening is formed radially-through the inner tubular member, wherein the valve system is positioned within the annulus, wherein the valve system comprises an intermediate tubular member having a second opening formed radially-therethrough, wherein the first valve is positioned at least partially in the intermediate tubular member, wherein a third opening is formed radially-through the first valve, and wherein the degradable member is configured to at least partially degrade in response to contact with a first fluid.

17. The method of claim 16, further comprising gravel packing the wellbore prior to actuating the valve system.

18. The method of claim 16, further comprising producing hydrocarbons from the wellbore after the valve system is actuated.

19. The method of claim 16, further comprising running the downhole tool into the wellbore in a fluid that does not degrade the degradable member.

20. The method of claim 19, further comprising running the downhole tool into the wellbore in an oil-based fluid.

21. The method of claim 16, further comprising degrading the degradable member with a gravel packing fluid.

22. The method of claim 16, further comprising degrading the degradable member with a spacer fluid.

23. The method of claim 16, further comprising degrading the degradable member with a water-based fluid.

24. The method of claim 16, further comprising running the downhole tool into the wellbore in a first fluid and gravel packing the wellbore with a second fluid, wherein one of the first fluid and the second fluid is an oil-based fluid, and the other of the first fluid and the second fluid is a water-based fluid.

25. A downhole tool, comprising:

a housing comprising a screen; and a valve system positioned within the housing, the valve system comprising:

a first valve;

a flow control device;

a first degradable member configured to at least partially degrade in response to contact with a first fluid; and a second degradable member configured to at least partially degrade in response to contact with a second fluid that is different from the first fluid;

wherein the valve system has a first position where the first valve allows a flow within the housing, a second position where the first valve directs at least a portion of the flow through the flow control device, and a third position stopping flow through the flow control device;

wherein the valve system is configured to actuate from the first position to the second position in response to the first degradable member at least partially degrading; and wherein the valve system is configured to actuate from the second position to the third position in response to the second degradable member at least partially degrading.

* * * * *